US007696931B2

(12) United States Patent
Kim et al.

(10) Patent No.: US 7,696,931 B2
(45) Date of Patent: Apr. 13, 2010

(54) ANTENNA FOR ENHANCING BANDWIDTH AND ELECTRONIC DEVICE HAVING THE SAME

(75) Inventors: Hong-Teuk Kim, Gyeonggi-Do (KR); Kyung-Hack Yi, Seoul (KR); Ho-Seon Lee, Chungcheongnam-Do (KR)

(73) Assignee: LG Electronics, Inc., Seoul (KR)

( * ) Notice: Subject to any disclaimer, the term of this patent is extended or adjusted under 35 U.S.C. 154(b) by 225 days.

(21) Appl. No.: 11/604,122

(22) Filed: Nov. 22, 2006

(65) Prior Publication Data

US 2007/0115183 A1 May 24, 2007

(30) Foreign Application Priority Data

Nov. 24, 2005 (KR) ..... 10-2005-0113147
Nov. 24, 2005 (KR) ..... 10-2005-0113152
Mar. 29, 2006 (KR) ..... 10-2006-0028608

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS

2004/0135729 A1* 7/2004 Talvitie et al. ..... 343/702

FOREIGN PATENT DOCUMENTS

| | | |
|---|---|---|
| EP | 1 372 213 A1 | 12/2003 |
| KR | 2005-0003341 | 1/2005 |
| KR | 10-0636384 | 10/2006 |

* cited by examiner

*Primary Examiner*—Trinh V Dinh
*Assistant Examiner*—Dieu Hien T Duong
(74) *Attorney, Agent, or Firm*—Lee, Hong, Degerman, Kang & Waimey

(57) ABSTRACT

An antenna comprises a high frequency antenna body, and a low frequency antenna body electrically connected to a point of the high frequency antenna body where a high frequency current distribution is minimized. By independently designing a high frequency bandwidth and a low frequency bandwidth from each other, an antenna having an optimum function in a desired frequency band can be easily fabricated.

24 Claims, 14 Drawing Sheets

ANTENNA FOR ENHANCING BANDWIDTH AND ELECTRONIC DEVICE HAVING THE SAME

RELATED APPLICATION

Pursuant to 35 U.S.C. §119(a), this application claims the benefit of earlier filling date and right of priority to Korean Application Nos. 10-2005-113147, 10-2005-113152 and 10-2006-28608, filed on Nov. 24, 2005, Nov. 24, 2005 and Mar. 29, 2006, respectively, the contents of which are herein expressly incorporated by reference in their entirety.

BACKGROUND OF THE INVENTION

1. Field of the Invention

The present invention relates to an antenna for transceiving an electric wave and an electronic device having the same, and more particularly, to an antenna capable of independently designing multi bands from each other and enhancing a bandwidth, and an electronic device having the same.

2. Description of the Background Art

An electronic device having a communication means therein receives an electric wave and generates information from a received electric wave, or transmits the generated information in an electric wave manner. The electronic device includes a portable terminal such as a portable phone, a personal digital assistants (PDA), a vehicle navigation, etc., a portable computer such as a notebook, an electronic diary, an electronic dictionary, etc., and a music reproducer such as an MP3 player, an MD player, a radio, an audio, etc.

The electronic device has to implement not only an excellent function but also an excellent design to satisfy a user's desire.

According to the recent trend for a slim design, the conventional outwardly protruded antenna is mounted in the electronic device, thereby reducing the entire size of the electronic device and enhancing the appearance of the electronic device.

The internal antenna called as an In-tenna has to have an excellent efficiency suitable for a small electronic device. Reducing the size of the In-tenna is a very important task.

Recently, an electronic device for a wide bandwidth such as GSM900/1800/1900 or WCDMA2100 is being actively developed. The electronic device for a wide bandwidth has to be provided with a multi-bandwidth antenna for transceiving service of a wide-bandwidth.

However, due to a coupling phenomenon between a low frequency bandwidth and a high frequency bandwidth, that is, since one bandwidth is degraded when another bandwidth is upgraded, it is difficult to design an optimum antenna having a bandwidth more than a certain degree at both the low frequency bandwidth and the high frequency bandwidth.

Recently, a research for enhancing an antenna bandwidth so as to transceive multi-band signals is being actively performed.

SUMMARY OF THE INVENTION

Therefore, an object of the present invention is to provide an antenna capable of enhancing a bandwidth, and an electronic device having the same.

Anther object of the present invention is to provide an antenna capable of independently designing a high frequency bandwidth and a low frequency bandwidth, and an electronic device having the same.

To achieve these and other advantages and in accordance with the purpose of the present invention, as embodied and broadly described herein, there is provided an antenna, comprising: a first antenna body; and a second antenna body surrounding at least one portion of the first antenna body so that at least one portion thereof can be parallel with the first antenna body, wherein a direction of a current flowing on at least one portion of the second antenna body parallel with the first antenna body is equal to a direction of a current flowing on the first antenna body.

According to a first embodiment of the present invention, the second antenna body comprises a first conductor having one end electrically connected to the first antenna body in parallel; a second conductor disposed to be parallel with the first conductor with the first antenna body being interposed therebetween, and having one end grounded to a ground surface; and a connection conductor for connecting another end of the first conductor and another end of the second conductor.

The first antenna body is formed to have a length of ¼ of a wavelength corresponding to a center frequency of a desired high frequency bandwidth, and the second antenna body is formed to have a length of ½ of the wavelength corresponding to the center frequency.

One end of the first antenna body and one end of the second antenna body are electrically connected to a feeding line, respectively. Another end of the second antenna body is grounded to a ground surface by a ground line.

The antenna according to the present invention may comprise a high frequency antenna body; and a low frequency antenna body electrically connected to a point of the high frequency antenna body where a high frequency current distribution is minimized.

According to a second embodiment of the present invention, the high frequency antenna body comprises a first antenna body; and a second antenna body surrounding at least one portion of the first antenna body so that a direction of a current flowing on at least one portion thereof can be parallel with a direction of a current flowing on the first antenna body.

The second antenna body comprises a first conductor having one end electrically connected to the first antenna body in parallel, and disposed to be parallel with the first antenna body; a second conductor disposed to be parallel with the first conductor with the first antenna body being interposed therebetween, and having one end grounded to a ground surface; and a connection conductor for connecting another end of the first conductor and another end of the second conductor. The low frequency antenna body has a spiral shape, and is electrically connected to the connection conductor.

According to a third embodiment of the present invention, the antenna comprises a first antenna body and a second antenna body separated from each other by a slot for enhancing a bandwidth. The slot comprises first and second slots disposed between the first antenna body and the second antenna body in parallel with each other; a third slot for connecting one end of the first slot with one end of the second slot; and a fourth slot connected to one of the first slot and the second slot, and extended between the feeding line and the ground line, thereby opening one of the first slot and the second slot.

The first slot and the second slot may have lengths different from each other, or may have the same length.

The low frequency antenna body is provided with a fifth slot so that one side thereof can be opened.

A dielectric substance may be interposed between the ground surface and the first and second antenna bodies.

The feeding line and the ground line are curved towards the ground surface from one side of the second antenna body. The high frequency antenna body is curved from another side of the second antenna body towards the ground surface so as to face the feeding line and the ground line.

The low frequency antenna body comprises a third antenna body, and a connection body for electrically connecting the third antenna body with the high frequency antenna body in serial.

According to a fourth embodiment of the present invention, the connection body is one-time curved from the high frequency antenna body in one direction along one bending line, and is two-time curved from the high frequency antenna body in another direction along another bending line. The connection body is curved at each angle of 90°.

According to a fifth embodiment of the present invention, the high frequency antenna body comprises first to third slots connected to one another so as to constitute a 'U'-shape, a fourth slot for opening the 'U'-shaped slot, a fifth slot formed at the third antenna body so as to be outwardly opened, a sixth slot formed at the third antenna body so as to be disconnected from outside, and a seventh slot formed at the connection body so as to be disconnected from outside.

To achieve these and other advantages and in accordance with the purpose of the present invention, as embodied and broadly described herein, there is also provided an electronic device having an antenna for transceiving an electric wave, the antenna comprising: a first antenna body; and a second antenna body surrounding at least one portion of the first antenna body so that at least one portion thereof can be parallel with the first antenna body, wherein a direction of a current flowing on at least one portion of the second antenna body parallel with the first antenna body is equal to a direction of a current flowing on the first antenna body.

The electronic device according to the present invention may have an antenna comprising a high frequency antenna body; and a low frequency antenna body electrically connected to a point of the high frequency antenna body where a high frequency current distribution is minimized.

The electronic device comprises a portable terminal, a portable computer, an MP3 player, an MD player, a radio, and an audio.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, an antenna and an electronic device according to the present invention will be explained in more detail.

Figure 1:
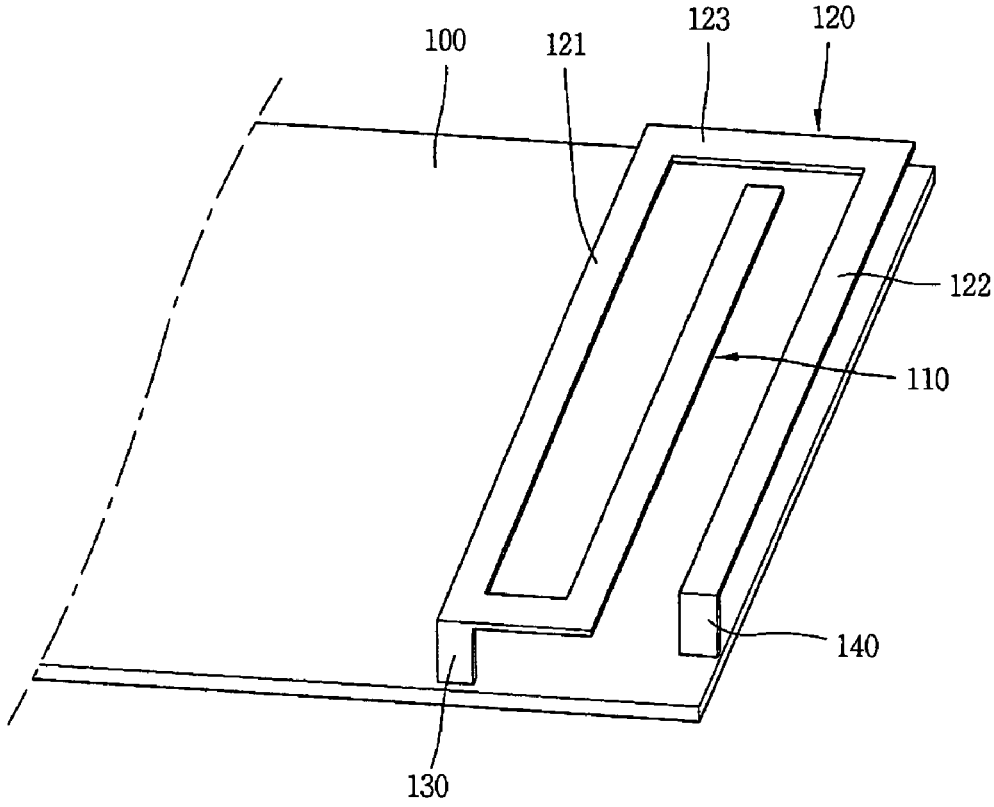
FIG. 1 is a perspective view schematically showing an antenna according to a first embodiment of the present invention.
Figure 2:
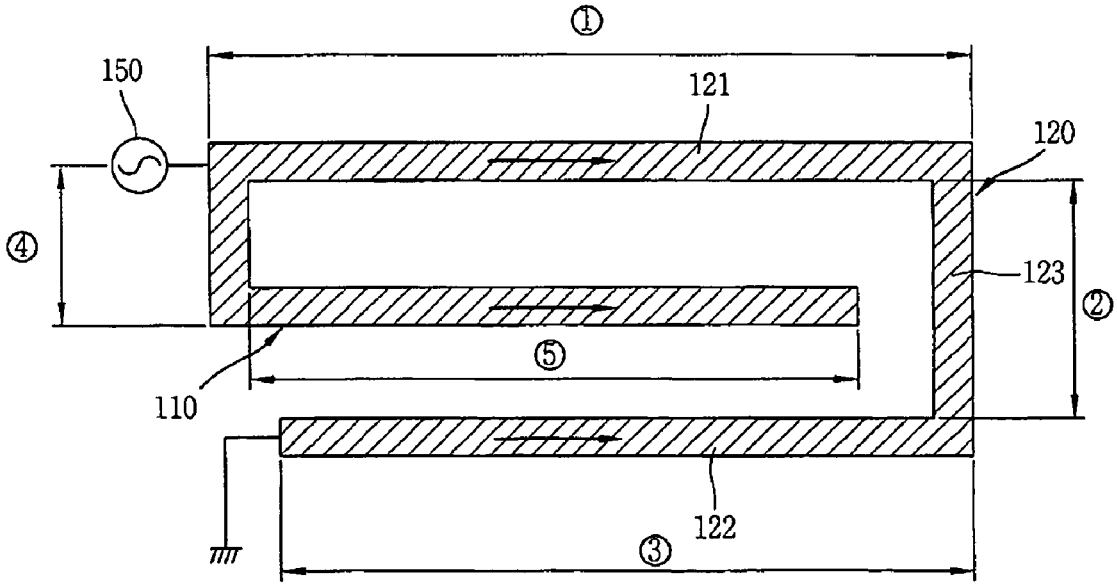
FIG. 2 is a plan view showing the antenna of FIG. 1.

Referring to FIGS. 1 and 2, the antenna according to a first embodiment of the present invention comprises: a ground surface 100; a first antenna body 110; a second antenna body 120 electrically connected to the first antenna body 110 in parallel; a feeding line 130 for supplying a current to the first antenna body 110 and the second antenna body 120; and a ground line 140 for grounding the second antenna body to the ground surface 100.

The ground surface 100 has a flat surface, and is formed of a conductor. The ground surface 100 may be fabricated by forming a conductor film in a printed circuit board (PCB) mounted in an electronic device.

The ground surface 100 is provided with a signal line pattern for supplying a current to the first antenna body 110 and the second antenna body 120. The feeding line 130 is electrically connected with the signal line pattern by a contact. A current generated from an oscillator 150 is supplied to the first antenna body 110 and the second antenna body 120 via the signal line pattern and the feeding line 130. The feeding line 130 may be electrically connected with the oscillator 150 through the ground surface 100.

The first antenna body 110 and the second antenna body 120 for emitting or receiving an electric wave are electrically connected with the oscillator 150 in parallel.

The first antenna body 110 is formed to have a length (④+⑤) of ¼ of a wavelength corresponding to a center frequency of a desired high frequency bandwidth. A current supplied to the first antenna body 110 flows in the same direction without being inverted.

The second antenna body 120 is formed to have a length (①+②+③) of ½ of the wavelength corresponding to the center frequency of the desired high frequency bandwidth. The second antenna body 120 is curved as a 'U'-shape so as to surround a part of the first antenna body 100. The second antenna body 120 includes a first conductor 121, a second conductor 122, and a connection conductor 123.

One end of the first conductor 121 is connected with the feeding line 130. The first conductor 121 is spaced from the first antenna body 110 in parallel with each other.

One end of the second conductor 122 is grounded with the ground surface 100 by the ground line 140. The second conductor 122 is arranged to be parallel with the first conductor 121 with the first antenna body 110 being disposed therebetween. Preferably, the second conductor 122 has the same length as the first conductor 121. When the second conductor 122 does not have the same length as the first conductor 121, it has a length closest to the length of the first conductor 121.

The connection conductor 123 for connecting another end of the first conductor 121 with another end of the second conductor 122, is arranged in a direction approximately perpendicular to the first antenna body 110. In the preferred embodiment of the present invention, the connection conductor 123 has a linear shape. However, the connection conductor 123 can have any shape such as an arc shape as long as it can electrically connect the first conductor 121 with the second conductor 122. The connection conductor 123 may be implemented as a curved portion of the second antenna body 120.

As the second antenna body 120 is formed to have a length (①+②+③) of ½ of the wavelength corresponding to the center frequency of the desired high frequency bandwidth, a flowing direction of a current supplied to the second antenna body 120 is inverted. However, since the second conductor 122 is arranged to be parallel with the first antenna body 110 as the second antenna body 120 is curved, each current supplied to the first antenna body 110, the first conductor 121, and the second conductor 122 has the same flowing direction in parallel with each other as indicated by the arrow in FIG. 2. Accordingly, an electromagnetic field generated from the first antenna body 110 is coupled with an electromagnetic field generated from the first conductor 121 and the second conductor 122. As the result, a plurality of high resonance frequencies H1 and H2 move in a direction approaching to each other, thereby increasing a bandwidth at the high frequency band as shown in FIG. 6.

Figure 6:
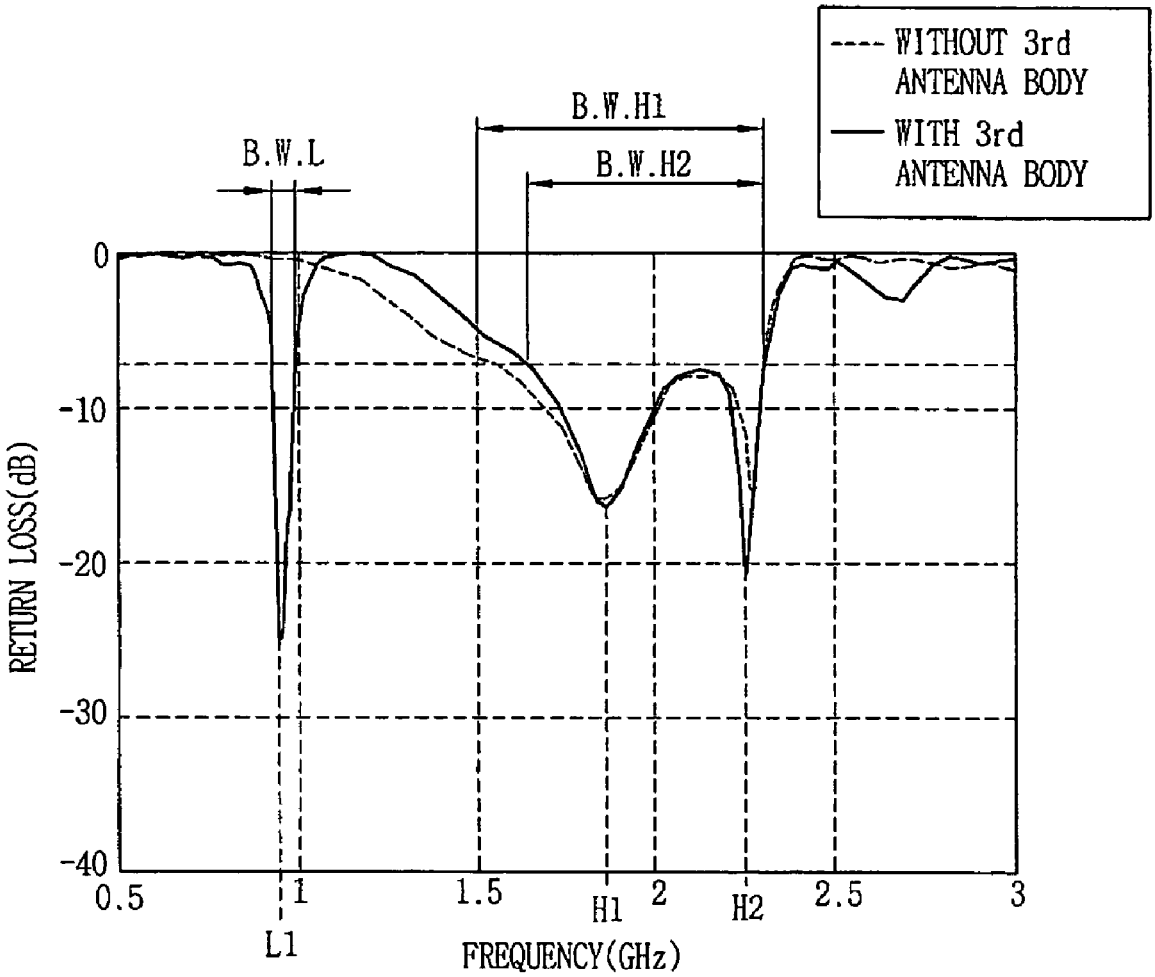
FIG. 6 is a graph showing a return loss of each antenna shown in FIGS. 1 and 3.

Referring to FIG. 6, the dotted line indicates a return loss according to the high frequency antenna body of FIG. 1. As a result of an experiment, a first high resonance frequency (H1) was 1.5 GHz, and a second high resonance frequency (H2) was 2.35 GHz. As the electromagnetic field generated from the first antenna body 110 and the electromagnetic field generated from the first conductor 121 and the second conductor 122 are coupled with each other, the first high resonance frequency (H1) and the second high resonance frequency (H2) move in a direction approaching to each other. As the result, a high frequency bandwidth (B.W.H1) was increased up to 850 MHz, and a ratio between the high frequency bandwidth and the center frequency was increased up to 44%, which shows a considerable increase than the conventional ratio of 24% at 460 MHz.

Referring to FIGS. 1 and 2, the feeding line 130 for supplying a current to the first antenna body 110 and the second antenna body 120 is electrically connected with the signal line pattern formed on the ground surface 100. However, the feeding line 130 may be connected with the oscillator 150 with various structures.

The ground line 140 for grounding the second antenna body 120 to the ground surface 100 is formed accordingly as one end of the second conductor 122 is curved. However, an additional ground line 140 may be attached to the second conductor 122.

In the present invention, one end of the second conductor 122 is grounded to the ground surface 100 so that the second conductor 122, the first conductor 121, and the first antenna body 110 can have the same current direction. As long as a current supplied to the first and second conductors 121 and 122 has the same flowing direction as a current supplied to the first antenna body 110, various structures may be implemented in the present invention.

Since the first and second conductors 121 and 122 are arranged to be parallel with the first antenna body 110 and each current supplied thereto has the same flowing direction, an electromagnetic field generated from the first and second conductors 121 and 122 is coupled with an electromagnetic field generated from the first antenna body 110 thereby to increase a bandwidth.

Figure 3:
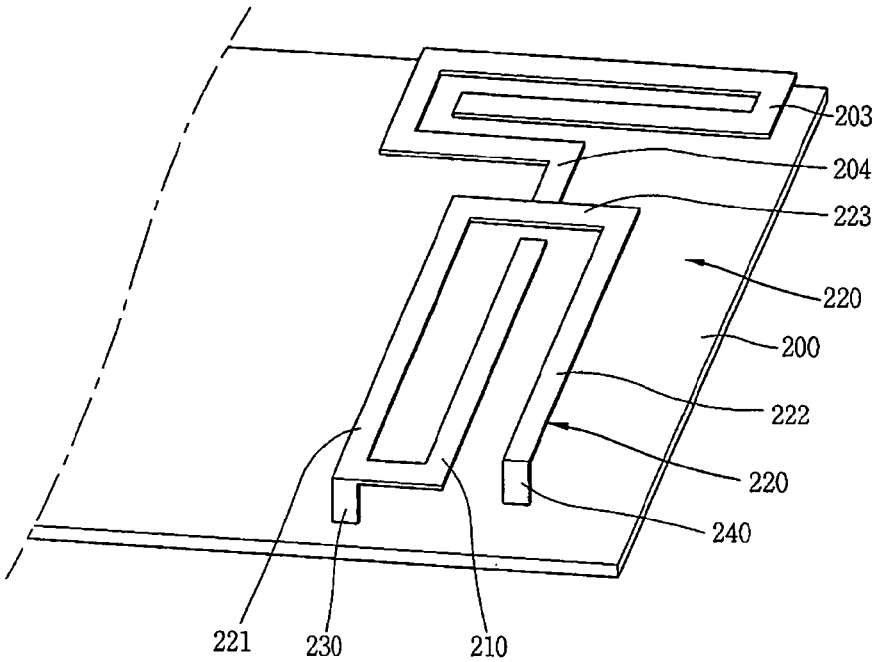
FIG. 3 is a perspective view schematically showing an antenna according to a second embodiment of the present invention.
Figure 4:
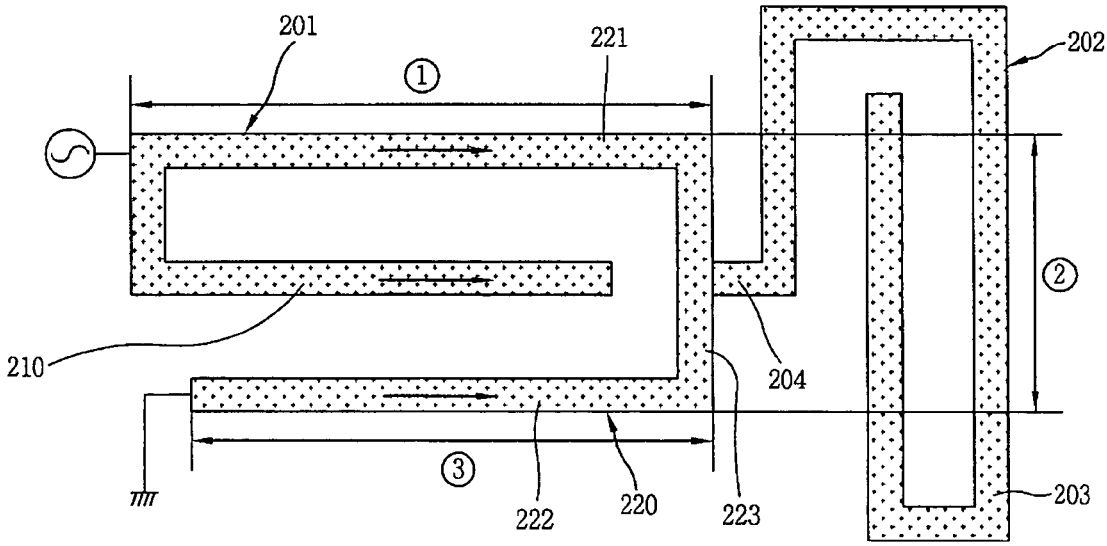
FIG. 4 is a plan view showing the antenna of FIG. 3.
Figure 5:
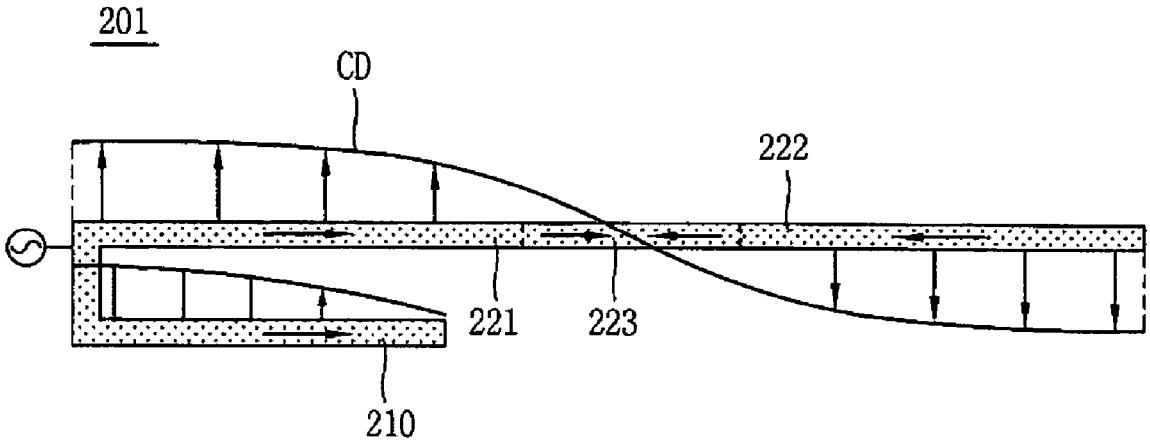
FIG. 5 is a configuration view schematically showing a current distribution of a high frequency antenna body of FIG. 4.

FIGS. 3 to 5 are perspective views schematically showing an antenna according to a second embodiment of the present invention. The antenna according to the second embodiment of the present invention comprises a ground surface 200, a high frequency antenna body 201, a low frequency antenna body 202, a feeding line 230, and a ground line 240.

The high frequency antenna body 201 has the same structure as the antenna according to the first embodiment. That is, the high frequency antenna body 201 includes a first antenna body 210, and a second antenna body 220 electrically connected to the first antenna body 210 in parallel.

The first antenna body 210 is formed to have a length of ¼ of a wavelength corresponding to a center frequency of a desired high frequency bandwidth.

The second antenna body 220 is electrically connected to the first antenna body 210 in parallel. One end of the second antenna body 220 is connected to the feeding line 230, and another end thereof is grounded to the ground surface 200 by the ground line 240. The second antenna body 220 is curved two times, and includes first and second conductors 221 and 222 disposed to be parallel with each other, and a connection conductor 223 for connecting the first and second conductors 221 and 222 with each other.

The first and second conductors 221 and 222 are arranged to be parallel with each other under a state that the first antenna body 210 is interposed therebetween. The second antenna body 220 is formed to have a length (①+②+③) of ½ of the wavelength corresponding to the center frequency of the desired high frequency bandwidth. Accordingly, each current supplied to the first and second conductors 221 and 222 has the same flowing direction in parallel with each other as indicated by the arrow in FIG. 4.

The connection conductor 223 includes a center point of the length (①+②+③) of the second antenna body 220, that is, a point of ¼ of the wavelength corresponding to the center frequency of the desired high frequency bandwidth. As shown in FIG. 5, on the basis of the point, a phase of a high frequency current is inverted. At the point of ¼ of the wavelength corresponding to the center frequency of the desired high frequency bandwidth, a high frequency current distribution is minimized (theoretically, a high frequency current does not flow).

Like in the first embodiment, the feeding line 230 is electrically connected to the first and second antenna bodies 210 and 220, thereby supplying a current to the first and second antenna bodies 210 and 220.

Like in the first embodiment, the ground line 240 grounds another end of the second antenna body 220 to the ground surface 200.

The low frequency antenna body 202 includes a third antenna body 203, and a connection body 204 for electrically connecting the third antenna body 203 with the high frequency antenna body 202.

The low frequency antenna body 202 serves to generate a resonance in a low frequency bandwidth. The third antenna body 203 is electrically connected with a point of the connection conductor 223 by the connection body 204, the point where a high frequency current distribution is minimized.

On the third antenna body 203, a minimum high frequency current flows. Accordingly, an electromagnetic field generated from the third antenna body 203 by a high frequency current has a minimum coupling with an electromagnetic field generated from the first and second antenna bodies 210 and 220 by a high frequency current. This means that a resonance frequency or a bandwidth at a high frequency band is not influenced by the third antenna body 203, and thus a low frequency band and a high frequency band can be independently performed from each other. The above characteristics are represented in the graph of FIG. 6 showing a return loss according to a frequency.

Referring to FIG. 6, the first and second high resonance frequencies H1 and H2 without the low frequency antenna body 202, that is, without the third antenna body 203 (dotted line) is almost identical to the first and second high resonance frequencies H1 and H2 with the low frequency antenna body 202, that is, with the third antenna body 203 (solid line). A low resonance frequency is generated at 0.96 GHz by the low frequency antenna body 202, thereby generating a low frequency bandwidth (B.W.L) of 80 MHz based on a return loss of −6 dB. A high frequency bandwidth (B.W.H2) of 720 MHz according to the second embodiment is somewhat narrower than that of the first embodiment, but is considerably wider than the conventional high frequency bandwidth of 460 MHz.

In the preferred embodiment of the present invention, the third antenna body 203 has a spiral shape. However, any structure having a low resonance frequency may be applied to the present invention.

As aforementioned, each current applied to the first and second conductors arranged in parallel with each other, and the first antenna body interposed therebetween has the same flowing direction. Accordingly, an electromagnetic field generated from the first and second conductors is coupled with an electromagnetic field generated from the first antenna body, thereby enhancing a bandwidth at a high frequency band.

Furthermore, the low frequency antenna body is electrically connected with a point of the high frequency antenna body where a high frequency current distribution is minimized. Accordingly, the high frequency current does not flow to the low frequency antenna body, and thus an influence on a high frequency band by the low frequency antenna body is minimized.

Since the high frequency antenna body and the low frequency antenna body can be independently designed from each other, the antenna design is facilitated and an optimum function for the antenna is implemented.

FIGS. 7 to 14 are perspective views schematically showing an antenna according to a third embodiment of the present invention, which show modification examples of the antenna according to the second embodiment.

Figure 7:
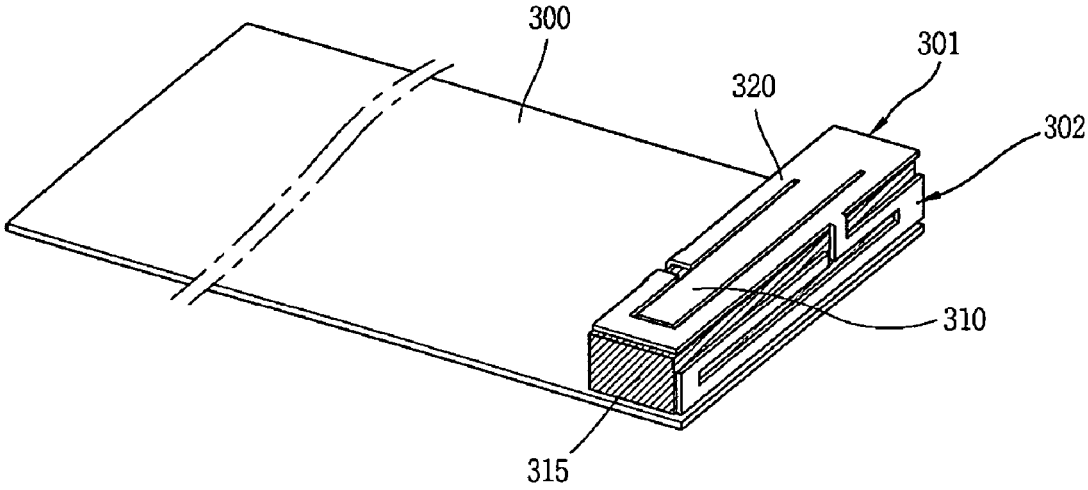
FIG. 7 is a perspective view schematically showing an antenna according to a third embodiment of the present invention.
Figure 8:
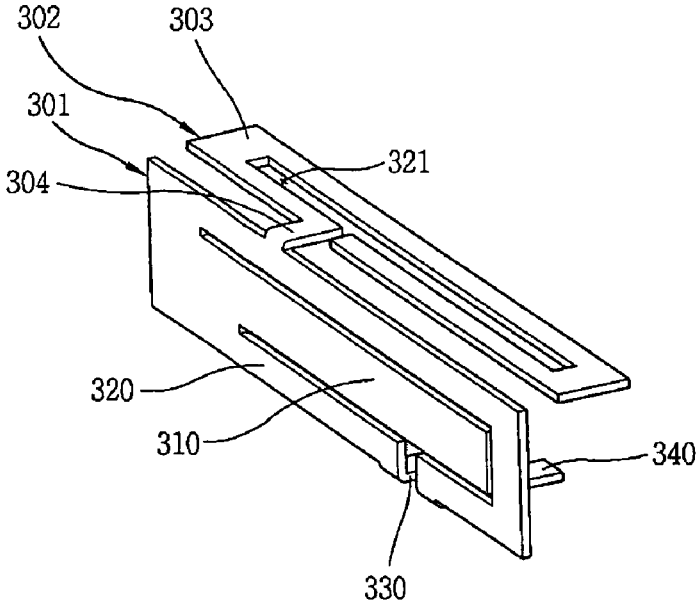
FIG. 8 is a perspective view showing the antenna of FIG. 7 from another angle.

Referring to FIG. 7, the antenna according to the third embodiment of the present invention comprises: a ground surface 300 having a flat surface and formed of a conductor; a high frequency antenna body 301 disposed at an upper portion of the ground surface 300; a low frequency antenna body 302 electrically connected to a point of the high frequency antenna body 301 where a high frequency current distribution is minimized; a feeding line 330 for supplying a current to the high frequency antenna body 301; and a ground line 340 for grounding the high frequency antenna body 301 to the ground surface 300.

The high frequency antenna body 301 includes a first antenna body 310, and a second antenna body 320 curved so as to surround most parts of the first antenna body 310.

The first antenna body 310 is electrically connected with the second antenna body 320 in parallel, and has a length of ¼ of a wavelength corresponding to the center frequency.

One end of the second antenna body 320 is connected with the feeding line 330, and another end thereof is grounded to the ground surface 300 by the ground line 340. The second antenna body 320 is formed so as to surround most parts of the first antenna body 310. The first and second antenna bodies 310 and 320 are separated from each other by first to third slots 311, 312 and 313. Preferably, a length of the second antenna body 320 is ½ of a wavelength corresponding to the center frequency of a desired high frequency band.

The first to third slots 311, 312 and 313 form an approximately 'U'-shape. A fourth slot 314 is formed between the feeding line 330 and the ground line 340, thereby opening the first to third slots 311, 312 and 313.

In the preferred embodiment of the present invention, the low frequency antenna body 302 is electrically connected to a point of the high frequency antenna body 301 where a high frequency current distribution is minimized. Furthermore, a bandwidth at a low frequency band or a high frequency band is controlled by the size and the shape of the first to fourth slots 311, 312, 313 and 314.

Figure 10:
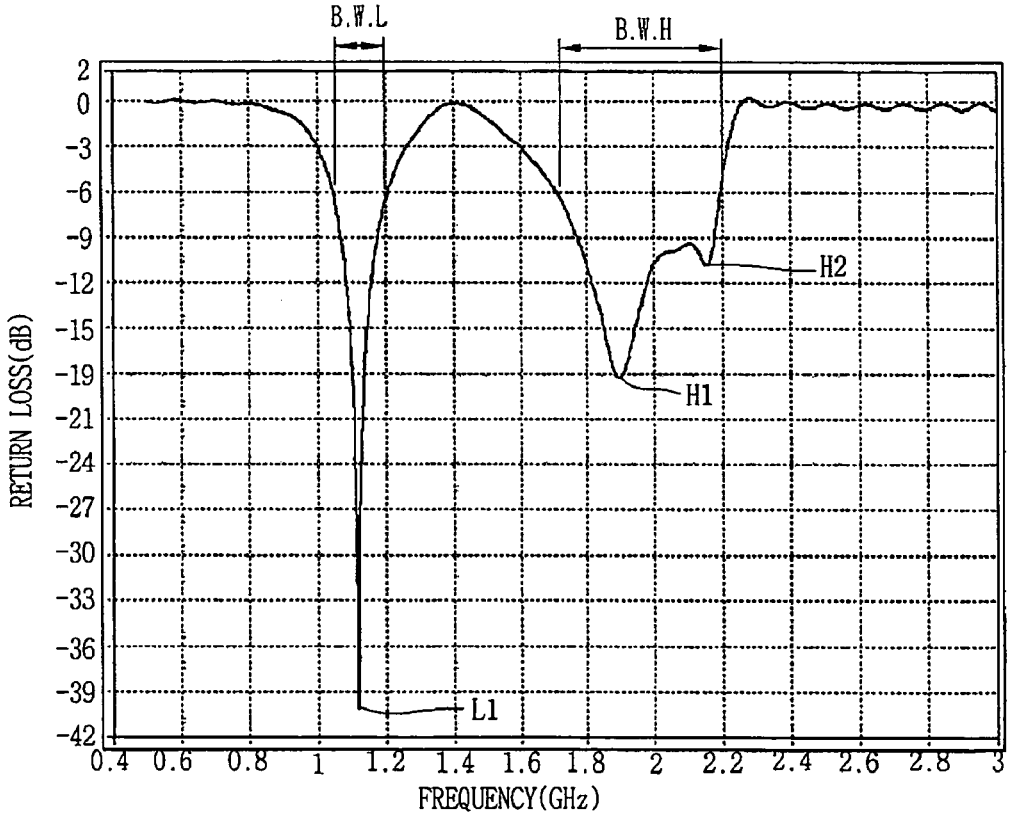
FIG. 10 is a graph showing a return loss of the antenna of FIG. 7.

In the aspect of the first to fourth slots 311, 312, 313 and 314 not the first and second antenna bodies 310 and 320, the first and second slots 311 and 312 disposed to be in parallel with each other, and the third slot 313 for connecting each end of the first and second slots 311 and 312 form an approximately 'U'-shape. Herein, when the 'U'-shape is formed by the slots, a double resonance frequency is generated. Referring to FIG. 10, the first high resonance frequency H1 is generated at approximately 1.9 GHz, and the second high resonance frequency H2 is generated at approximately 2.15 GHz.

Figure 11:
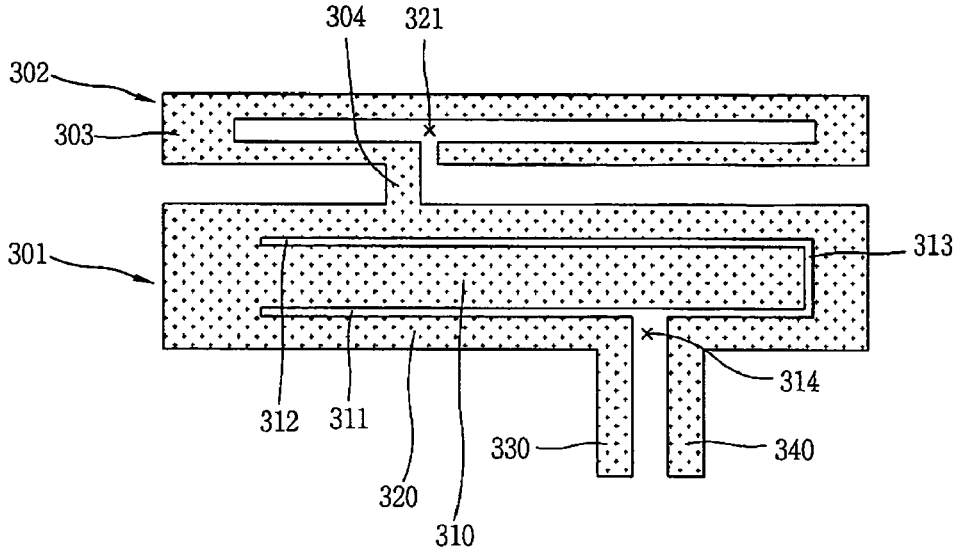
FIG. 11 is an unfolded view showing a modified state of the antenna of FIG. 9 so that a first slot and a second slot can have the same length.
Figure 12:
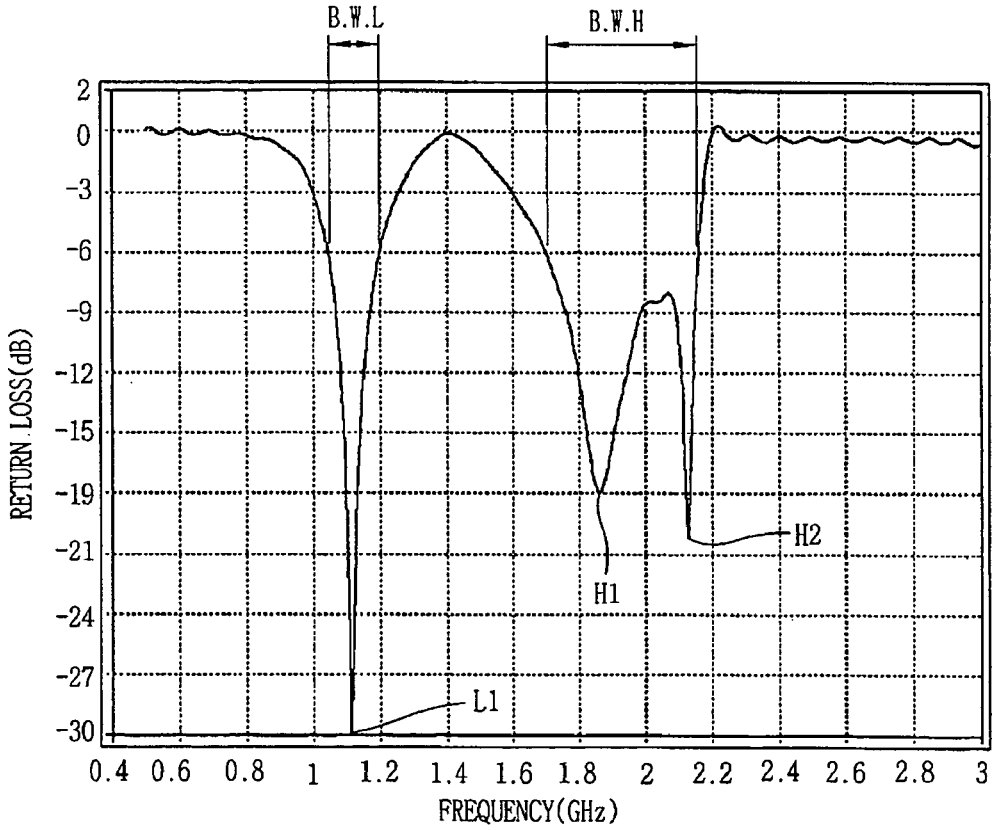
FIG. 12 is a graph showing a return loss of the antenna of FIG. 11.

A frequency characteristic is varied according to the size, the length, the width, etc. of the slots 311, 312 and 313. Referring to FIG. 11, the first slot 311 is formed so as to have the same length as the second slot 312. As shown in FIG. 12, the return loss RL is greatly decreased at the second high resonance frequency H2.

TABLE 1

| | First slot < second slot | First slot = second slot |
|---|---|---|
| Bandwidth | 1.7~2.2 GHz (bandwidth: 0.5) | 1.7~2.15 GHz (bandwidth: 0.45) |
| Return loss at H2 | −10.5 dB | −20 dB |

As shown in the above table 1, when the first slot 311 has a length shorter than that of the second slot 312, a bandwidth is 1.7~2.2 GHz, and the return loss at the second high resonance frequency H2 is −10.5 dB. On the contrary, when the first slot 311 has the same length as the second slot 312, the bandwidth is 1.7~2.15 GHz, and the return loss at the second high resonance frequency H2 is −20 dB. That is, when the first slot 311 has a length shorter than that of the second slot 312, the bandwidth is more widened even if the return loss is increased than in the case that the first slot 311 has the same length as the second slot 312.

A frequency characteristic such as the number of multi-resonance, a return loss, etc., is varied according to the number, the size, the length, the width, etc. of the slots 311, 312 and 313. Accordingly, an antenna function can be enhanced by controlling the number, the size, the length, the width, etc. of the slots at the time of designing the antenna.

A frequency bandwidth for the antenna can be widened by the fourth slot 314 formed between the feeding line 330 and the ground line 340 so as to be connected with the first slot 311.

Figure 9:
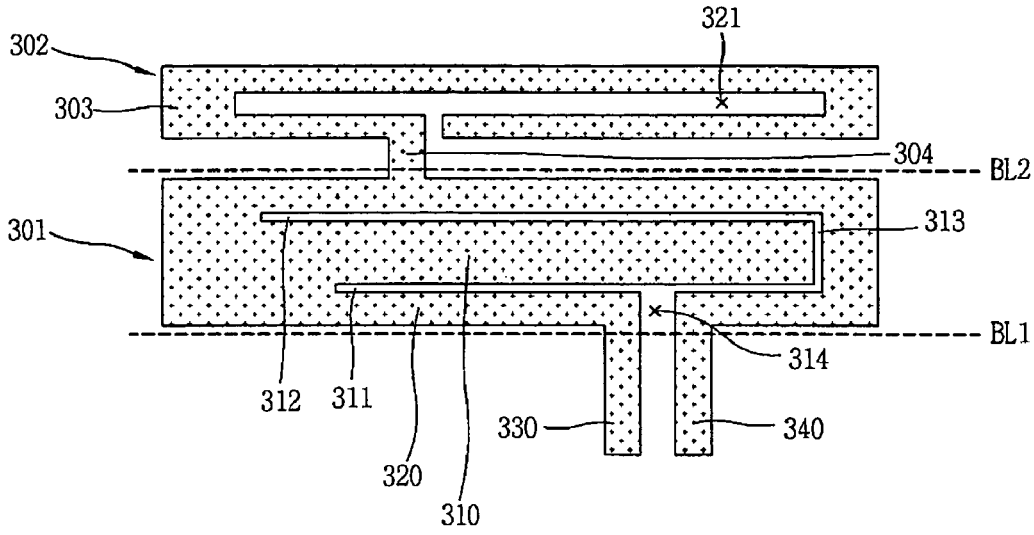
FIG. 9 is an unfolded view of the antenna of FIG. 7.

The fourth slot 314 increases a length of a transmitting circuit generated by the feeding line 330 and the ground line 340, thereby influencing on an impedance and a frequency bandwidth for the antenna. As shown in FIG. 9, when the fourth slot 314 is extendingly-formed from a middle portion of the first slot 311 with an opened state between the feeding line 330 and the ground line 340, a bandwidth is widened. As shown in FIG. 10, a frequency bandwidth (B.W.H) at a high frequency band is approximately 1.7 GHz to 2.2 GHz on the basis of the return loss of −6 dB, which is much more increased than the conventional flat-plate type inverse F-antenna having a bandwidth of 1.9 GHz to 2.1 GHz on the basis of the return loss of −6 dB.

Considering that the $3^{rd}$ mobile communication (3G) being recently spot-lighted has a frequency bandwidth of 1.8 GHz, and considering that a mobile communication terminal being used for a satellite DMB has a bandwidth of an L-band (1 to 2 GHz) or an S-band (2 to 4 GHz), the antenna according to the present invention can transceive a clear electric wave at the same bandwidth.

Factors such as the number, the position, the length, the width, etc. of the fourth slot 314 influence on an impedance and a frequency bandwidth for the antenna. Accordingly, the antenna is designed by properly controlling the factors.

Figure 14:
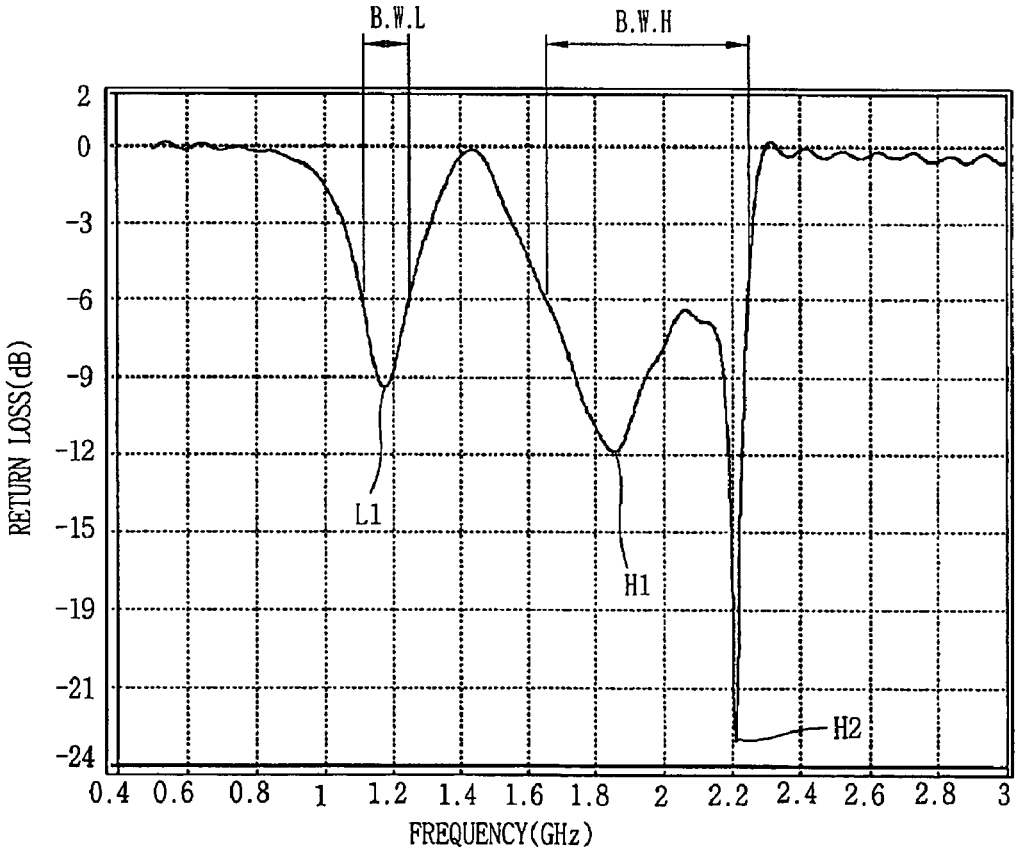
FIG. 14 is a graph showing a return loss of the antenna of FIG. 13.

The low frequency antenna body 302 is electrically connected to a point of the high frequency antenna body 301 where a high frequency current distribution is minimized. The low frequency antenna body 302 serves as a mono-pole antenna electrically connected to the high frequency antenna body 301 in serial. Generally, the mono-pole antenna is suitable for transceiving an electric wave of a low frequency band such as a terrestrial wave or a sky wave. The low frequency antenna body 302, the mono-pole antenna has a resonance frequency of a low frequency band, thereby transceiving a clear electric wave of a low frequency band. As shown in FIGS. 10, 12, and 14, a low resonance frequency L1 is generated at approximately 1.1 GHz due to the low frequency antenna body 302.

The low frequency antenna body 302 includes a third antenna body 303, and a connection body 304 for connecting the third antenna body 303 to a point of the second antenna body 320 where a high frequency current distribution is minimized.

The third antenna body 303 is formed by vertically curving the connection body 304 towards the ground surface 300 so as to face the feeding line 330 and the ground line 340. Accordingly, an entire volume of the antenna is reduced, and an electronic device having the antenna is minimized.

As shown in FIGS. 9 to 11, a fifth slot 321 is formed at the third antenna body 303. By the fifth slot 321, a low frequency bandwidth is widened. The low frequency bandwidth is controlled by controlling the number, the position, the size, the width, etc., of the fifth slot 321.

As shown in FIGS. 9 to 14, an opened position of the fifth slot 321 based on the connection body 304 influences on a return loss and a frequency bandwidth, which is shown in the following table 2.

TABLE 2

| | Opening of fifth slit towards right side of connection body (refer to FIGS. 9 to 11) | Opening of fifth slit towards left side of connection body (refer to FIG. 13) |
|---|---|---|
| Return loss at L1 | −30 dB | −9 dB |
| B.W.L | 1.05~1.2 GHz (bandwidth: 0.15) | 1.1~1.25 GHz (bandwidth: 0.15) |
| Return loss at H2 | −20 dB | −23 dB |
| B.W.H | 1.7~2.15 GHz (bandwidth: 0.45) | 1.65~2.25 GHz (bandwidth: 0.6) |

As shown in FIGS. 9 to 11, when the fifth slot 321 is opened towards the right side of the connection body 304, the return loss at a low resonance frequency L1 is greatly lowered up to −30 dB as shown in FIGS. 10 to 12, and a low frequency bandwidth (B.W.L) is approximately 1.05 to 1.2 GHz (bandwidth: 0.15 GHz) on the basis of −6 dB. Also, the return loss at a second high resonance frequency H2 is −20 dB, and a high frequency bandwidth (B.W.H) is approximately 1.7 to 2.15 GHz (bandwidth: 0.45 GHz) on the basis of −6 dB.

Figure 13:
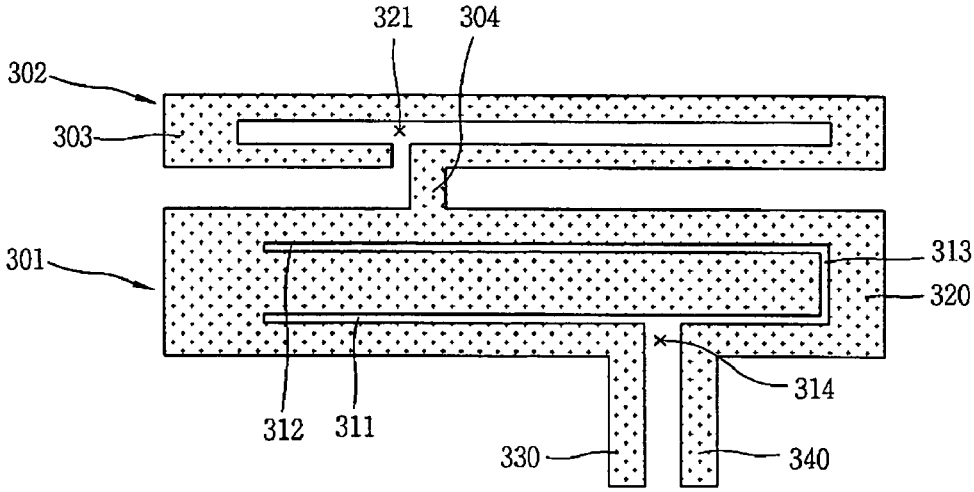
FIG. 13 is an unfolded view of the antenna of FIG. 7, in which an opened direction of a fifth slot is modified to an opposite direction.

On the contrary, as shown in FIG. 13, when the fifth slot 321 is opened towards the left side of the connection body 304, the return loss at a low resonance frequency L1 is −9 dB, and a low frequency bandwidth (B.W.L) is approximately 1.1 to 1.25 GHz (bandwidth: 0.15 GHz). Also, the return loss at a second high resonance frequency H2 is −23 dB, and a high frequency bandwidth (B.W.H) is approximately 1.65 to 2.25 GHz (bandwidth: 0.6 GHz) which is somewhat widened than in the case that the fifth slot 321 is opened towards the right side of the connection body 304. By controlling each position of the connection body 304 and the fifth slot 321, the reflection loss according to the frequency and the bandwidth can be varied.

As shown in FIG. 7, an insulating dielectric substance 315 is inserted between the high frequency antenna body 301 and the ground surface 300. Since the high frequency antenna body 301 to which a current has been supplied through the feeding line 330 is installed at an upper portion of the ground surface 300 in parallel with each other, a potential difference is generated between the ground surface 300 and the high frequency antenna body 301. The distance between the high frequency antenna body 301 and the ground surface 300 can be shortened by inserting the insulating dielectric substance 315 therebetween, the insulating dielectric substance 315 having a permittivity greater than that of the air. By shortening the distance between the high frequency antenna body 301 and the ground surface 300, an electronic device having the antenna can be miniaturized.

In the preferred embodiment of the present invention, the insulating dielectric substance 315 entirely fills between the high frequency antenna body 301 and the ground surface 300.

However, the insulating dielectric substance 315 may partially fill between the high frequency antenna body 301 and the ground surface 300.

Referring to FIG. 9, a fabrication process for the antenna according to the third embodiment of the present invention will be explained. First, the slots 311, 312, 313 and 314, the feeding line 330, the ground line 340, the low frequency antenna body 302, etc. are cuttingly-formed on a rectangular flat plate. Then, the feeding line 330 and the ground line 340 are curved along a first bending line BL1 in a direction perpendicular to the high frequency antenna body 301. Then, the low frequency antenna body 302 is curved along a second bending line BL2 in a direction perpendicular to the high frequency antenna body 301.

As shown in FIG. 7, an antenna having a small size of 40 mm(①)×8.6 mm(②)×6 mm(③) was substantially fabricated, the antenna suitable to be mounted in a slim mobile communication terminal.

Figure 15:
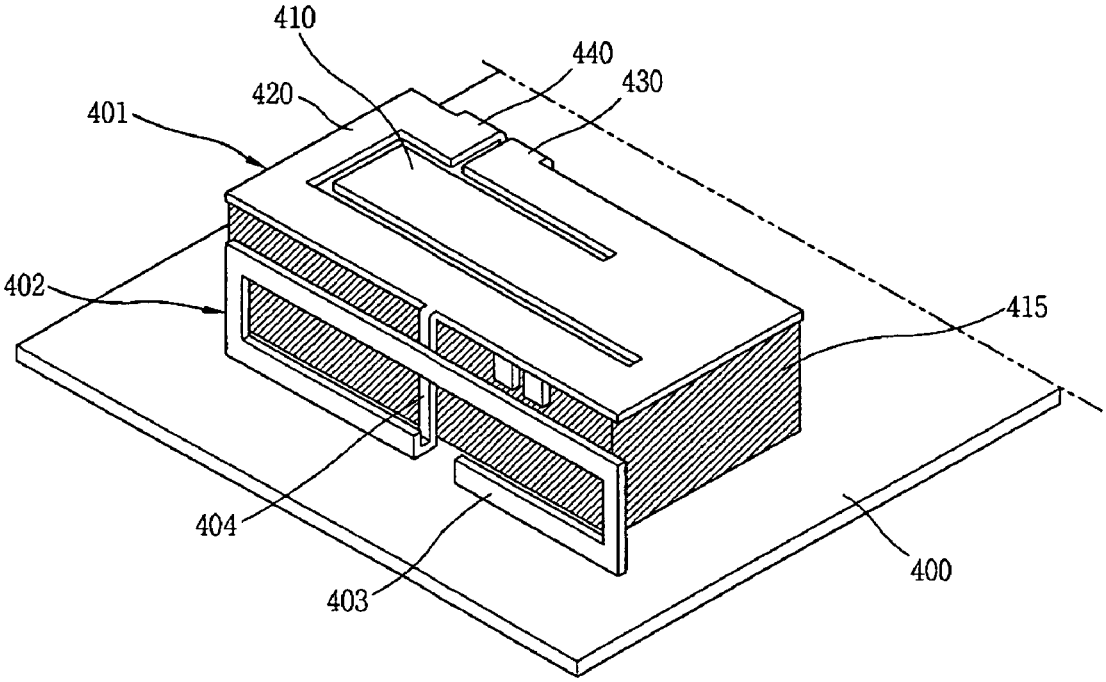
FIG. 15 is a perspective view schematically showing an antenna according to a fourth embodiment of the present invention.
Figure 16:
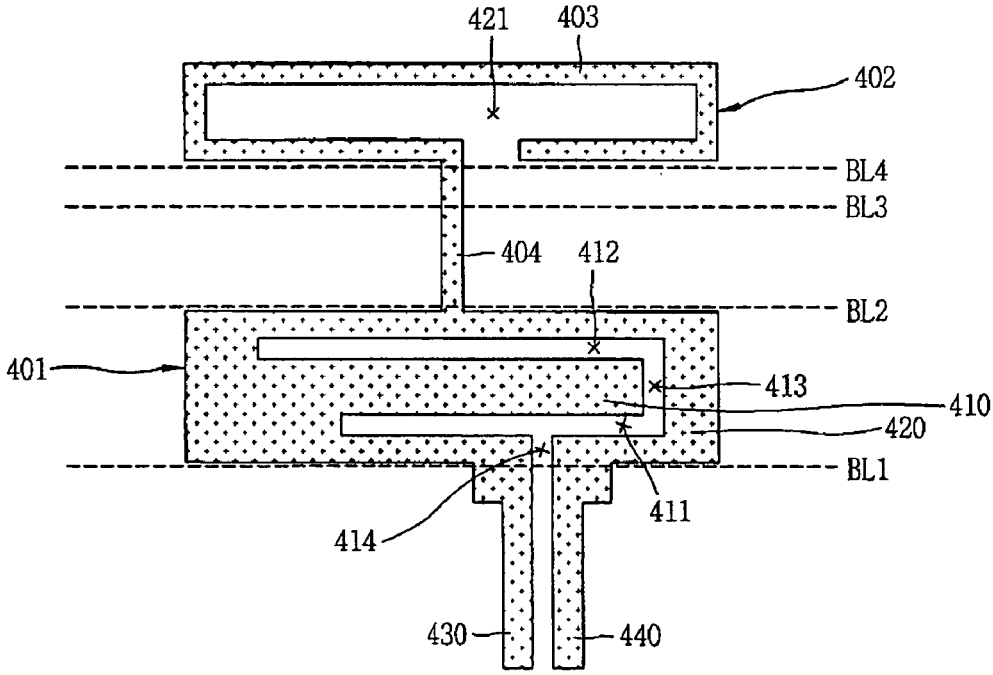
FIG. 16 is an unfolded view of the antenna of FIG. 15.

FIGS. 15 and 16 are perspective views schematically showing an antenna according to a fourth embodiment of the present invention. The antenna according to the fourth embodiment has a similar structure as the antenna according to the third embodiment. Referring to FIGS. 15 and 16, like the antenna according to the third embodiment, the antenna according to the fourth embodiment comprises: a ground surface 400; a high frequency antenna body 401; a low frequency antenna body 402 electrically connected to a point of the high frequency antenna body 401 where a high frequency current distribution is minimized; a feeding line 430 for supplying a current to the high frequency antenna body 401; and a ground line 440 for grounding the high frequency antenna body 401 to the ground surface 400.

Like in the third embodiment, in the fourth embodiment, the high frequency antenna body 401 includes a first antenna body 410 and a second antenna body 420. Also, the low frequency antenna body 402 includes a third antenna body 403 electrically connected to the second antenna body 420, and a connection body 404 for electrically connecting the third antenna body 403 to the second antenna body 420. First to fifth slots 411, 412, 413, 414 and 421 are provided, and a dielectric substance 415 is interposed between the first and second antenna bodies 410 and 420 and the ground surface 400.

However, as shown in FIGS. 15 and 16 according to the fourth embodiment, the connection body 404 is one-time curved towards the ground surface 400 along the second bending line BL2, and is two-times curved towards an opposite direction to the ground surface 400 along a third bending line BL3 and a fourth bending line BL4. Accordingly, while maintaining the size of the antenna as it is, the connection body 404 can have a length longer than that of the connection body according to the first embodiment. When the connection body 404 has a long length, a low resonance frequency due to the third antenna body 403 is lowered thus to design an antenna suitable for a low frequency band. In the fourth embodiment, a low frequency band and a high frequency band can be independently designed from each other, and a resonance frequency at a low frequency band can be controlled to be in an optimum state.

Figure 17:
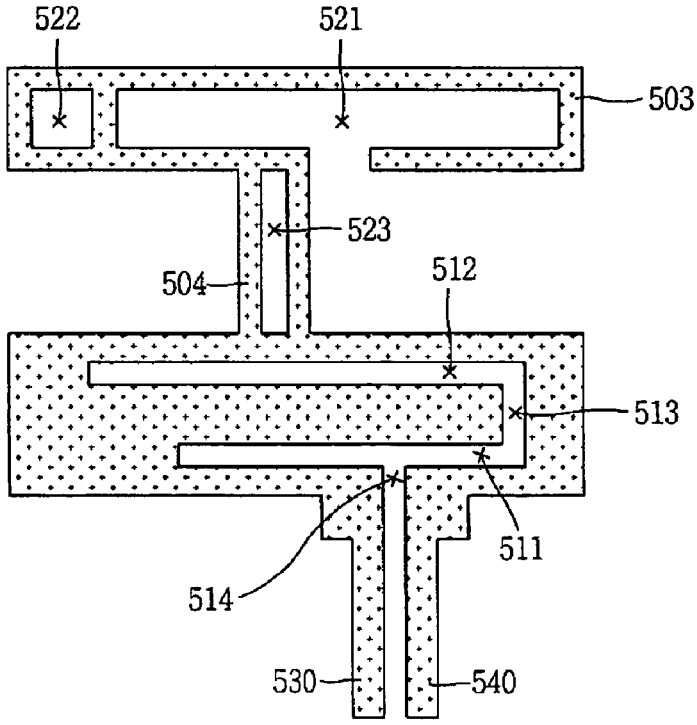
FIG. 17 is an unfolded view schematically showing an antenna according to a fifth embodiment of the present invention.
Figure 18:
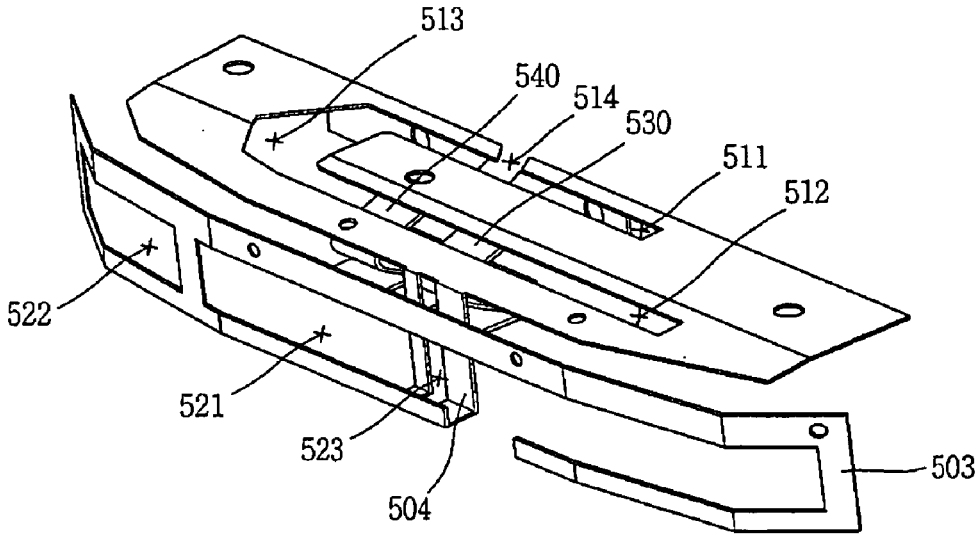
FIG. 18 is a perspective view showing a modification of the antenna of FIG. 17 for mounting in an electronic device.
Figure 19:
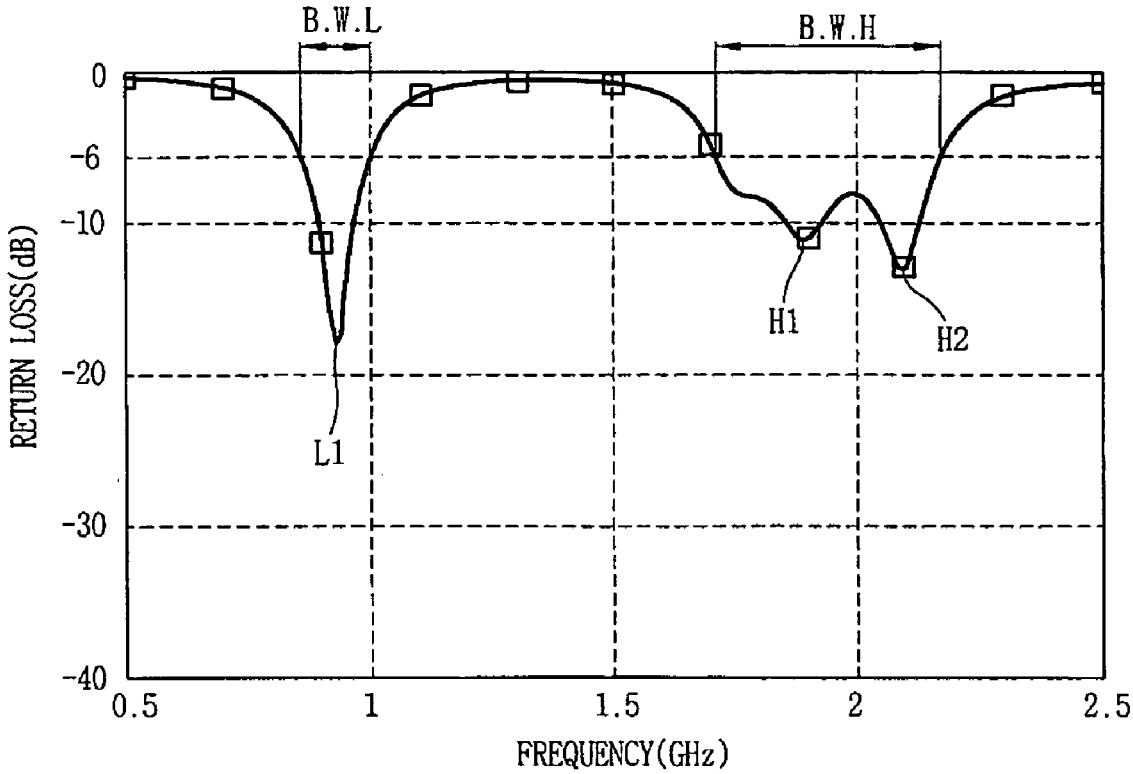
FIG. 19 is a graph showing a return loss of the antenna of FIG. 18.

FIGS. 17 to 19 are perspective views schematically showing an antenna according to a fifth embodiment of the present invention. The antenna according to the fifth embodiment has the same structure as the antenna according to the fourth embodiment except that a sixth slot 522 and a seventh slot 523 are additionally provided besides the first to fifth slots 511, 512, 513, 514 and 521.

Referring to FIG. 17, the sixth slot 522 is formed at the third antenna body 503 in a disconnected state from the fifth slot 521 without being outwardly opened, thereby reducing a return loss at a low resonance frequency and enhancing a bandwidth.

The seventh slot 523 is formed at the connection body 504 without being outwardly opened, thereby enabling an impedance matching for an antenna.

By controlling the number, the size, the length, the position, etc. of the slot formed at the connection body 504 or the third antenna body 503, a frequency characteristic at a low frequency band can be tuned.

FIG. 18 shows an antenna fabricated from the antenna of FIG. 17 so as to be mounted in an electronic device. As shown in FIG. 18, both ends of the third antenna body 503 are curved by a certain angle so as to be mounted in an electronic device with a small space. The antenna is fabricated to have a size of 40 mm (horizontal length)×8.6 mm (vertical length)×6 mm (height), thereby being mounted in a slim mobile communication terminal.

FIG. 19 is a graph showing a return loss for the antenna of FIG. 18, which is shown as the following table 3.

TABLE 3

| Characteristic | Antenna of preferred embodiment |
|---|---|
| Low resonance frequency | 0.9 GHz |
| Return loss | −18 dB |
| Low frequency bandwidth | 0.86~0.99 GHz (bandwidth: 0.13 GHz) |
| First high resonance frequency | 1.9 GHz |
| Return loss | −11 dB |
| Second high resonance frequency | 2.1 GHz |
| Return loss | −13 dB |
| High frequency bandwidth | 1.7~2.17 GHz (bandwidth: 0.47 GHz) |

As shown in FIG. 19 and the table 3, the antenna has a return loss of −18 dB at a low resonance frequency (0.9 GHz), which shows an excellent characteristic, and a low frequency bandwidth is 0.86 to 0.99 GHz. The return loss at a first high resonance frequency (1.9 GHz) is −11 dB, and the return loss at a second high resonance frequency (2.1 GHz) is −13 dB, thereby having an excellent antenna characteristic. Also, a high frequency bandwidth is 1.7 to 2.17 GHz, which shows a wide band characteristic.

Figure 20:
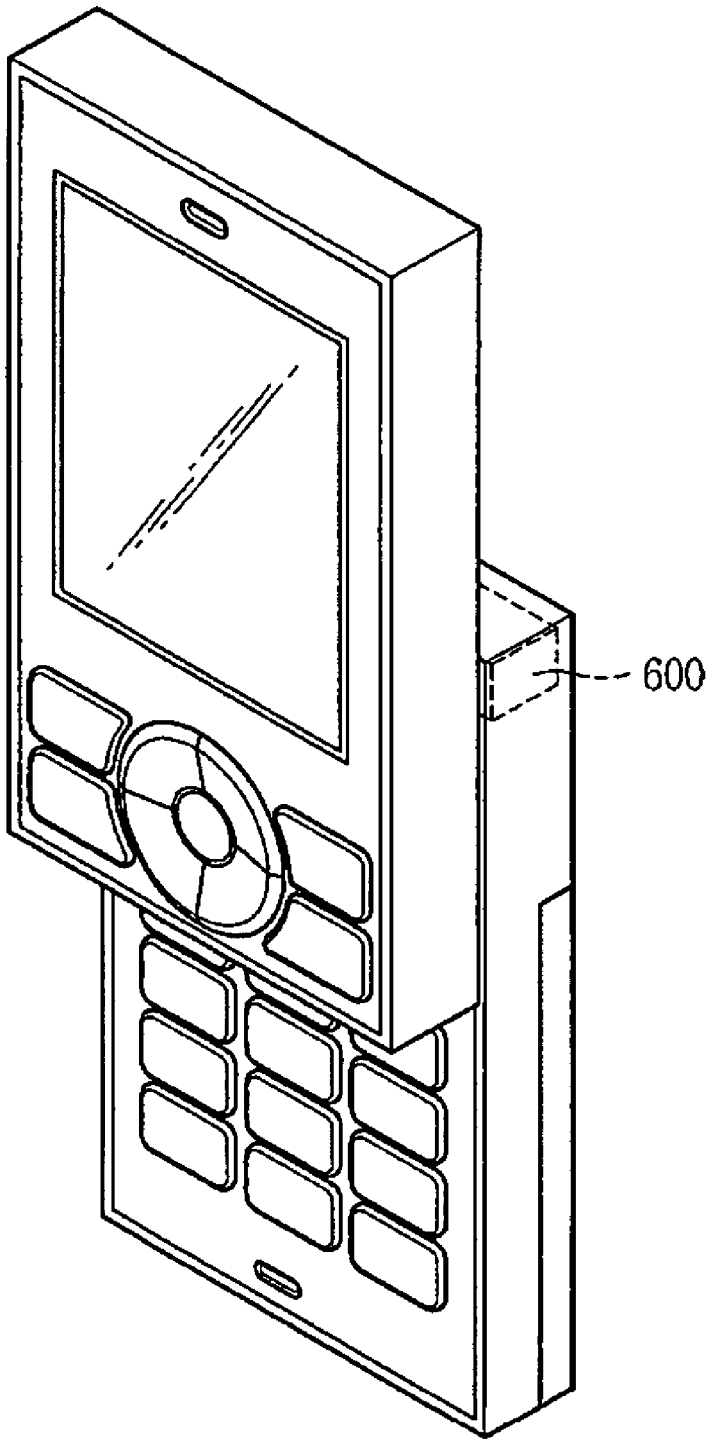
FIG. 20 is a perspective view schematically showing a mobile phone to which the antenna according to the present invention has been applied.
Figure 21:
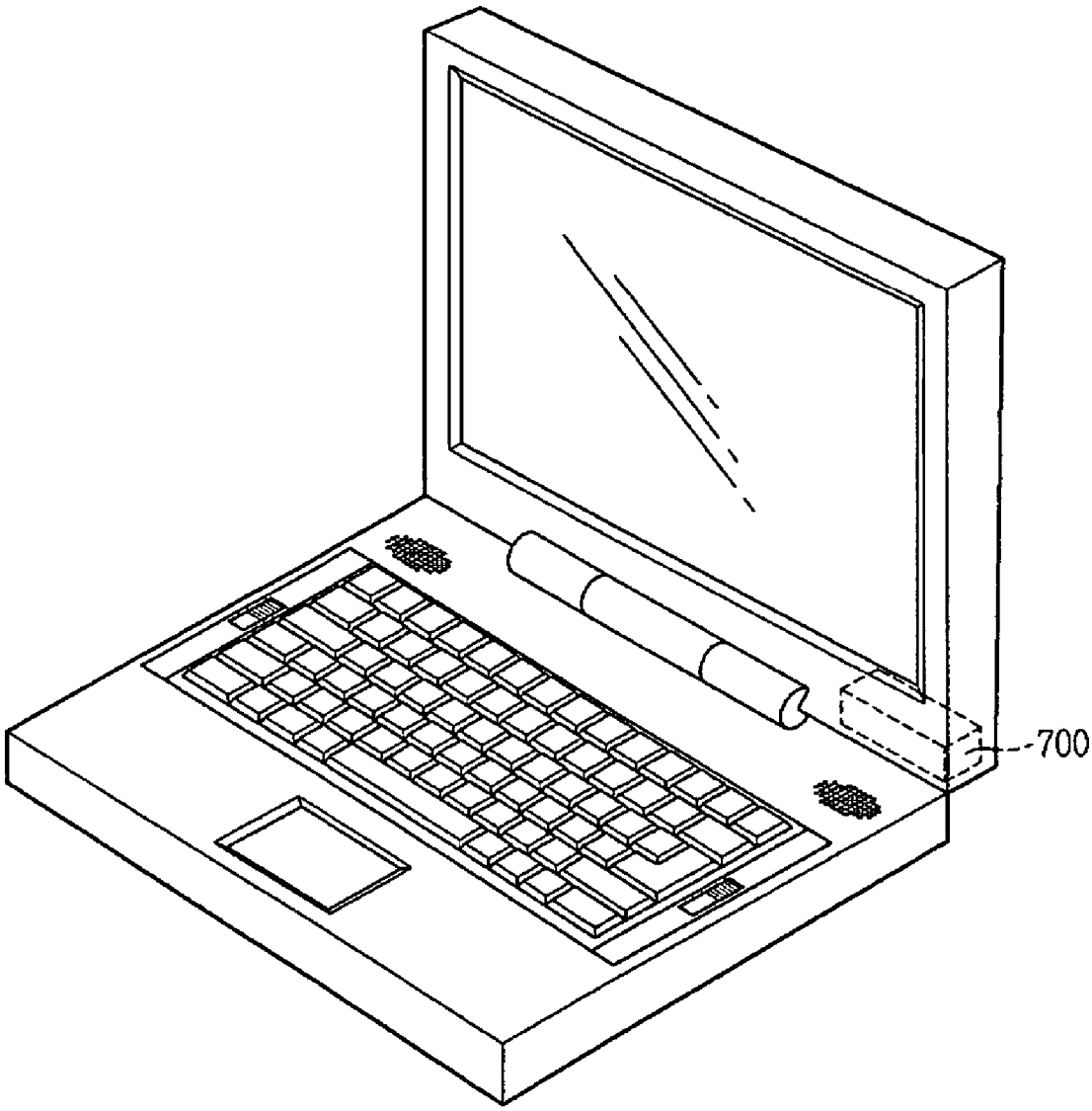
FIG. 21 is a perspective view schematically showing a notebook to which the antenna according to the present invention has been applied.
Figure 22:
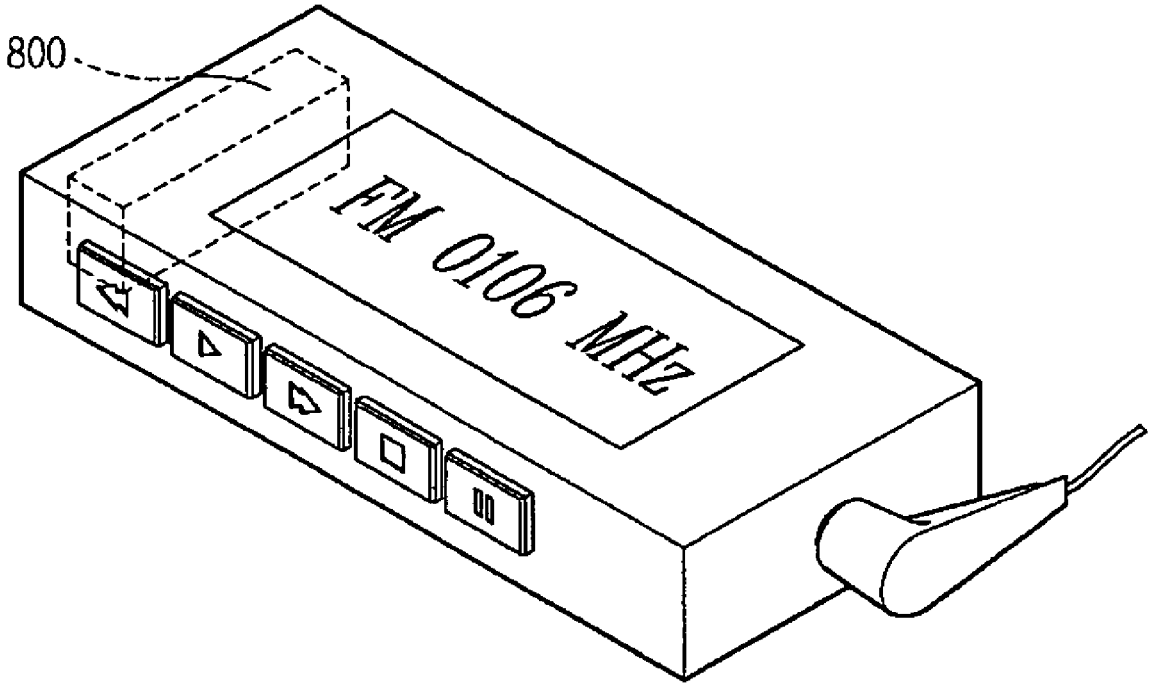
FIG. 22 is a perspective view schematically showing an MP3 player to which the antenna according to the present invention has been applied.

FIGS. 20 to 22 are perspective views showing each state that the antennas 600, 700 and 800 according to the first to fifth embodiments are applied to each electronic device, in which FIG. 20 is a perspective view showing a mobile phone to which the antenna 600 has been applied, FIG. 21 is a perspective view showing a notebook to which the antenna 700 has been applied, and FIG. 22 is a perspective view showing an MP3 player to which the antenna 800 has been applied.

The antenna according to the present invention may be applied not only to the mobile phone, the notebook, and the MP3 player implemented in FIGS. 20 to 22, but also to various electronic devices including a portable terminal such as a vehicle navigation, a portable computer such as a computer, an electronic diary, and an electronic dictionary, a music reproducing apparatus such as an MD player, a radio, and an audio.

The antennas 600, 700, and 800 according to the present invention respectively occupy a small space in an electronic device, and transceive a multi-band signal having undergone a low frequency band and a high frequency band. Accordingly, the electronic devices having the antennas 600, 700 and 800 therein have small sizes, and can be used for multi-band service.

As aforementioned, in the present invention, the low frequency antenna body having a resonance frequency at a low frequency band is electrically connected to a point of the high frequency antenna body where a high frequency current distribution is minimized, thereby minimizing flow of a high frequency current onto the low frequency antenna body. Accordingly, the high frequency band and a low frequency band can be independently designed from each other, thereby facilitating an antenna design and implementing an optimum antenna function at a desired frequency band.

Second, a flowing direction of a current applied onto the first antenna body is equal to that applied onto the second antenna body in parallel with each other for a coupling between the first antenna body and the second antenna body, thereby enhancing a bandwidth.

Third, the first to sixth slots are formed at the high frequency antenna body and the low frequency antenna body, thereby more enhancing the bandwidth. By controlling the number, the size, and an opened state of each slot, an antenna suitable for a desired frequency band of an electronic device can be designed.

Fourth, the antenna according to the present invention can be easily fabricated by cutting a flat plate and then by curving it. The low frequency antenna body, the feeding line, and the ground line are curved in a direction perpendicular to the high frequency antenna body, thereby miniaturizing the antenna.

Fifth, since the connection body is curved plural times, the antenna can be miniaturized and an antenna function can be optimized by an impedance matching.

Sixth, since the dielectric substance is interposed between the high frequency antenna body and the low frequency antenna body, the antenna can be miniaturized.

The present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An antenna, comprising:

a high frequency antenna body for transceiving a high frequency signal; and a low frequency antenna body for transceiving a low frequency signal, the low frequency antenna body electrically connected to the high frequency antenna body at a location where a high frequency current distribution is minimized, wherein the low frequency antenna body comprises a connection body formed at the location where the low frequency antenna body is connected to the high frequency antenna body, and wherein the high frequency antenna body is located in a first region and the low frequency antenna body is located in a second region, wherein the first and second regions are each located at opposite ends of the connection body, and wherein the high frequency antenna body and the low frequency antenna body are formed in opposite directions with respect to one another.

2. The antenna of claim 1, wherein the high frequency antenna body comprises:

a first antenna body; and a second antenna body surrounding at least one portion of the first antenna body, wherein a direction of a current flowing in at least one portion of the second antenna body is parallel with a direction of a current flowing in the first antenna body.

3. The antenna of claim 2, wherein the second antenna body comprises:

a first conductor having one end electrically connected to the first antenna body via a parallel connection and situated in parallel with the first antenna body;

a second conductor situated in parallel with the first conductor, wherein the first antenna body is located between the first and the second conductors, wherein one end of the second conductor is grounded to a ground surface; and a connection conductor for connecting another end of the first conductor to another end of the second conductor.

4. The antenna of claim 3, wherein a direction of a high frequency current at the connection conductor is reversed with respect to a direction of a current applied to the first and second conductors and a direction of a current applied to the first antenna body to equalize the current applied to the first and second conductors and the current applied to the first antenna body.

5. The antenna of claim 4, wherein the low frequency antenna body is electrically connected to the connection conductor.

6. The antenna of claim 2, wherein the low frequency antenna body has a spiral shape.

7. The antenna of claim 2, wherein a length of the first antenna body is ¼ of a wavelength corresponding to a center frequency of a desired high frequency bandwidth and a length of the second antenna body is ½ of the wavelength corresponding to the center frequency.

8. The antenna of claim 7, comprising:

a ground surface;

a feeding line for supplying a current to the first antenna body and the second antenna body; and a ground line for grounding the second antenna body to the ground surface.

9. The antenna of claim 8, wherein the first and second antenna bodies are separated from each other by at least one slot for enhancing a bandwidth.

10. The antenna of claim 9, wherein the at least one slot comprises:

first and second slots located between the first antenna body and the second antenna body, wherein the first and second slots are situated in parallel with each other;

a third slot for connecting one end of the first slot with one end of the second slot; and a fourth slot connected to one of the first and second slots, and extended between the feeding line and the ground line to open one of the first and second slots.

11. The antenna of claim 10, wherein the first and second slots have different lengths.

12. The antenna of claim 10, comprising a fifth slot formed at the low frequency antenna body to have one opened side.

13. The antenna of claim 8, wherein a dielectric substance is interposed between the ground surface and the first and second antenna bodies.

14. The antenna of claim 8, wherein the feeding line and the ground line are vertically curved from one side of the second antenna body towards the ground surface, and the low frequency antenna body is curved from another side of the second antenna body towards the ground surface to face the feeding line and the ground line.

15. The antenna of claim 1, wherein the low frequency antenna body comprises:

a third antenna body; and a connection body for electrically connecting the third antenna body with the high frequency antenna body.

16. The antenna of claim 15, wherein the connection body is at least one-time curved in a direction perpendicular to the high frequency antenna body.

17. The antenna of claim 15, wherein the connection body is curved from the high frequency antenna body in one direction along one bending line, and is two-time curved from the high frequency antenna body in another direction along another two bending lines different from each other.

18. The antenna of claim 17, wherein the connection body is curved at each angle of 90°.

19. The antenna of claim 15, wherein the high frequency antenna body comprises:

first to third slots connected to one another so as to constitute a 'U'-shape; and a fourth slot for opening the 'U'-shaped slot, and wherein the third antenna body comprises:

a fifth slot formed to be outwardly opened; and a sixth slot formed to be disconnected from outside.

20. The antenna of claim 19, wherein the connection body comprises a seventh slot formed to be disconnected from outside.

21. The antenna of claim 15, wherein the high frequency antenna body comprises:

first to third slots connected to one another so as to constitute a 'U'-shape; and a fourth slot for opening the 'U'-shaped slot, and wherein the connection body comprises a seventh slot formed to be disconnected from outside.

22. The antenna of claim 1, wherein the high frequency antenna body has a plate shape.

23. An electronic device having an antenna for transceiving signals, the antenna comprising:

a high frequency antenna body for transceiving a high frequency signal; and a low frequency antenna body for transceiving a low frequency signal, the low frequency antenna body electrically connected to the high frequency antenna body at a location where a high frequency current distribution is minimized, wherein the low frequency antenna body comprises a connection body formed at the location where the low frequency antenna body is connected to the high frequency antenna body, and wherein the high frequency antenna body is located in a first region and the low frequency antenna body is located in a second region, wherein the first and second regions are each located at opposite ends of the connection body, and wherein the high frequency antenna body and the low frequency antenna body are formed in opposite directions with respect to one another.

24. The electronic device of claim 23, wherein the electronic device comprises a portable terminal, a portable computer, an MP3 player, an MD player, a radio, and an audio.

* * * * *